US010773882B2

(12) United States Patent
Scherrer et al.

(10) Patent No.: US 10,773,882 B2
(45) Date of Patent: Sep. 15, 2020

(54) SHIPPING CONTAINER INSULATION PANEL AND INSTALLATION METHOD

(71) Applicants: Edward G. Scherrer, Mitchell, SD (US); Andrew Robert Scherrer, Mitchell, SD (US)

(72) Inventors: Edward G. Scherrer, Mitchell, SD (US); Andrew Robert Scherrer, Mitchell, SD (US)

( * ) Notice: Subject to any disclaimer, the term of this patent is extended or adjusted under 35 U.S.C. 154(b) by 119 days.

(21) Appl. No.: 15/916,851

(22) Filed: Mar. 9, 2018

(65) Prior Publication Data

US 2018/0273291 A1 Sep. 27, 2018

Related U.S. Application Data

(60) Provisional application No. 62/470,021, filed on Mar. 10, 2017.

(51) Int. Cl.

| | |
|---|---|
| ***E04H 1/02*** | (2006.01) |
| ***B65D 90/02*** | (2019.01) |
| ***E04B 1/348*** | (2006.01) |
| ***B65D 88/12*** | (2006.01) |

(52) U.S. Cl.

CPC ..... *B65D 90/023* (2013.01); *B65D 88/121* (2013.01); *E04B 1/3483* (2013.01)

(58) Field of Classification Search

CPC .... B65D 90/08; B65D 90/023; B65D 88/121; E04B 1/3483

USPC ..... 220/1.5, 592.2, 592.25, 592.26, 902, 220/DIG. 9

See application file for complete search history.

(56) References Cited

U.S. PATENT DOCUMENTS

| | | | |
|---|---|---|---|
| 2,169,254 | A | 8/1939 | Kotrbaty |
| 2,205,725 | A | 6/1940 | Kavanagh |
| 2,777,318 | A | 1/1957 | Kinsman |
| 2,836,266 | A | 5/1958 | Leeser |
| 2,950,575 | A | 8/1960 | Hellwig |
| 3,062,337 | A | 11/1962 | Zittle |
| 3,357,146 | A | 12/1967 | Gartrell |
| 3,362,120 | A | 1/1968 | Warren |
| 3,979,867 | A | 9/1976 | Sowinski |

(Continued)

FOREIGN PATENT DOCUMENTS

| | | | | |
|---|---|---|---|---|
| EP | 0492652 | A2 | 7/1992 | |
| WO | 2016018007 | | 2/2016 | |
| WO | WO2016018007 | * | 2/2016 | ..... E04B 1/80 |

OTHER PUBLICATIONS

International Search Report for corresponding International Patent Application No. PCT/US2018/021780 dated Jun. 15, 2018.

*Primary Examiner* — Elizabeth J Volz
(74) *Attorney, Agent, or Firm* — Merchant & Gould P.C.

(57) ABSTRACT

An insulation system is configured for mounting to corrugated walls such as the walls of a shipping container. A first end has a first coupling surface and a second end opposite the first end has a second complementary coupling surface. Mating alignment portions are on a top surface of the panel and on a bottom surface of the panel. The second face includes a corrugated surface with a protruding first surface parallel to the first face, a recessed second surface spaced apart from and parallel to the first surface, and third and fourth surfaces extending between the first surface and the second surface, the third and fourth surfaces being orthogonal to the first and second surfaces.

20 Claims, 18 Drawing Sheets

(56) References Cited

U.S. PATENT DOCUMENTS

| | | | | |
|---|---|---|---|---|
| 4,038,798 | A * | 8/1977 | Sachs | B28B 19/0038 52/309.7 |
| 4,163,349 | A | 8/1979 | Smith | |
| 4,244,151 | A | 1/1981 | Seem | |
| 4,288,962 | A | 9/1981 | Kavanaugh | |
| 4,333,290 | A | 6/1982 | Koberstein | |
| 4,375,741 | A | 3/1983 | Paliwoda | |
| 4,375,742 | A | 3/1983 | Paliwoda | |
| 4,429,503 | A | 2/1984 | Holliday | |
| 4,494,348 | A | 1/1985 | Kastelic | |
| 4,495,741 | A | 1/1985 | Pasiecznik | |
| 4,574,549 | A | 3/1986 | Holcombe | |
| 4,625,486 | A | 12/1986 | Dickinson | |
| 4,637,187 | A | 1/1987 | Campbell | |
| 4,769,963 | A | 9/1988 | Meyerson | |
| 4,811,537 | A | 3/1989 | D'Epenoux | |
| 4,862,660 | A | 9/1989 | Raymond | |
| 4,953,334 | A | 9/1990 | Dickens | |
| 5,279,089 | A | 1/1994 | Gulur | |
| 5,279,091 | A | 1/1994 | Williams et al. | |
| 5,758,464 | A | 6/1998 | Hatton | |
| 5,822,940 | A | 10/1998 | Carlin et al. | |
| 5,893,248 | A | 4/1999 | Beliveau | |
| 6,073,410 | A | 1/2000 | Schimpf et al. | |
| 6,076,315 | A | 1/2000 | Kondo | |
| 6,526,710 | B1 | 3/2003 | Killen | |
| 6,629,392 | B1 | 10/2003 | Harrel et al. | |
| 6,725,616 | B1 | 4/2004 | Pease | |
| 6,892,507 | B1 | 5/2005 | Pease | |
| 7,032,356 | B2 | 4/2006 | Layfield | |
| 7,543,419 | B2 | 6/2009 | Rue | |
| 7,670,527 | B2 | 3/2010 | Malis | |
| 7,963,080 | B1 | 6/2011 | Bowman | |
| 8,046,971 | B2 | 11/2011 | Lima | |
| 8,635,824 | B2 * | 1/2014 | Scherrer | E04B 1/80 52/309.16 |
| 2003/0140588 | A1 | 7/2003 | Sucato, Jr. | |
| 2003/0140592 | A1 | 7/2003 | Fjeld | |
| 2005/0204697 | A1 | 9/2005 | Rue | |
| 2005/0223669 | A1 | 10/2005 | Cymbala et al. | |
| 2008/0168728 | A1 | 7/2008 | Scherrer | |
| 2010/0325999 | A1 | 12/2010 | Devalapura | |
| 2011/0252728 | A1 | 10/2011 | Scherrer | |

* cited by examiner

SHIPPING CONTAINER INSULATION PANEL AND INSTALLATION METHOD

BACKGROUND OF THE INVENTION

Field of the Invention

The present invention is directed to an insulation panel and insulating system, and in particular to an insulation panel and system configured for use in shipping containers.

Description of the Prior Art

Wall systems that require finishing and/or insulation are well known and take on numerous configurations such as masonry, concrete modular units, poured concrete walls, wood frameworks and other common structural systems that generally provide satisfactory installation and support. Often, walls require insulation and may also require finishing over the insulation. Moreover, a vapor barrier should often be established to prevent or minimize mold and moisture damage and resist rusting or other corrosion. Moreover, such systems should avoid high thermal conductivity and resist rusting or other corrosion.

Various types of insulation systems have been developed and are widely used including fiberglass insulation. However, fiberglass insulation is susceptible to water damage and mold if moisture is present. In addition, the thickness required for adequate insulation may decrease the overall size of the space due to the added depth of the fiberglass layer. Fiberglass insulation is also difficult to handle and requires special gloves and a respirator. Many types of foam insulation have also been developed and utilized for many applications. However, such foam types of insulation are often open foam so that the material allows moisture to pass through and may retain some moisture. Common stud and foam insulation systems also suffer from difficult installation as may be required for wiring, switches, tubing and other components along with the insulation.

To overcome such problems, systems have been developed that provide an insulation layer using panels that align and attach with one another and mount to the wall. Such a panel type system is shown in U.S. Pat. No. 8,635,824 entitled INSULATION PANEL SYSTEM and issued to Scherrer. Such systems were sold under the commercial name INSOFAST and have proven to be very successful in providing superior insulation systems provides multiple advantages over prior art systems. The INSOFAST panel systems are widely adapted to many types of applications and able to be used for radon abatement under adsorptive claddings, under exterior insulation finish systems (EIFS), for retrofitting drain and dry insulation for exterior existing structures, for retrofit of drain and dry insulation for interior of existing structures. The system has been used in existing flooring, against foundation walls, above grade concrete or frame construction on either the interior or exterior and can be matched up to existing frame walls for extra insulation. The panels can be used as an insulation board when mounted on the exterior and can be used on top of existing floors or plaster walls, even if damaged, or on ceilings. The system might may also be used to add additional insulation to insulated concrete forms and can be used in multiple layers and used in precast applications and can snap in for chases to keep the chase ways open. This system forms a weather resistant barrier that does not require tape or adhesives and has self-sealing attachment points with the internal studs making installation simple and reliable.

Although the INSOFAST system of U.S. Pat. No. 8,635,824 has been successful for a wide range of uses, particular applications require a different approach. It can be appreciated that large shipping containers may have cargos or applications that require insulation. Moreover, such shipping containers have become popular for use as tiny homes. Their strength and standard sizes of shipping containers also make them suitable for modular construction with multiple shipping containers joined to form a larger structure. Use of the shipping containers for building construction also typically requires insulation. Standard shipping containers are typically made of steel and have a corrugated type wall structure. Such corrugated walls provide alternating spaced apart recesses and protrusions that reduce the effectiveness of planar insulation systems due to the gaps. Moreover, the corrugated type walls of shipping containers provide for more difficult installation due to the spaced apart recesses of the corrugations. To address such installation challenges, planar systems such as the INSOFAST insulation system have been supplemented with strips of insulation material cut and trimmed to fill in the spaces formed by the corrugated wall and therefore eliminate the gaps. Although this approach provides satisfactory insulation performance, installation can be challenging and labor intensive as strips must be cut and installed along with the planar panels to eliminate the gaps.

It can be appreciated that a new and improved system is needed that provides for superior insulation of corrugated walls such as are present with shipping containers. Such a system should fill the gaps formed by a corrugated wall structure. Moreover, such a system should provide for obtaining a planar outer exposed surface for easy mounting of additional layers and/or finishing. Such a system should also achieve water, thermal and vapor control layers or barriers and should provide for easily forming chases and channels for wiring, plumbing and other structure. Such a system should be easy to install and provide alignment between adjacent panels laterally and vertically. The present invention addresses these as well as other problems associated with insulation of corrugated walls.

SUMMARY OF THE INVENTION

The present invention is directed to a wall insulating system and in particular to a wall insulation and finishing system suitable for use with standard shipping containers having corrugated walls. The present invention utilizes foam insulating panels that are connected to form an insulation layer with a planar outer face. The panels include mounting stud type elements molded into the panels.

According to the present invention, standard shipping containers provide alternating spaced apart recesses and protrusions that are difficult to effectively insulate due to the gaps. Moreover, the corrugated type walls of shipping containers increase installation difficulty due to the spaced apart recesses of the corrugations. Closed cell foam insulation panels of the present invention have an inner mounting face that is complementary to the corrugated surface of shipping container walls. The panels form an exposed planar surface that may be painted, wallpapered, paneled or finished using other well-known techniques. The panels have molded in mounting elements that are spaced apart at uniform on center spacing generally corresponding to spacing for standard wood studs and allow for easily fastening with glue and conventional hardware to the shipping container wall. The mounting elements also provide for attachment of drywall, wood paneling and other inner finishing type layers to the insulating panel layer.

The panels are generally made of water impervious foam material so that the panels are lightweight and easily transported. In typical embodiments, the panels are 24 inches× approximately 44 inches or 16 inches by approximately 44 inches, allowing for easily handling the panels at jobsites. The panels have a tongue and groove configuration along the edges for connecting to adjacent panels both vertically and horizontally to create a continuous insulating layer for an entire wall. The panels include alignment tabs and complementary notches along the top and bottom edges to ensure a proper engagement and placement.

The panels also include channels, passages and/or chases for routing wiring, tubing or other elements. A small strip is formed along the edges so that when panels are connected in an edge to edge relationship, a channel or chase is formed continuing horizontally along adjacent panels between the ends of the ridges of adjacent panels. With this configuration, wiring and other elements may be routed both horizontally and vertically along the width and height of a wall without having to modify the panels. The edges of the panels also have drainage channels so that water and moisture are directed back toward each face of the panel keeping water from migrating through the panel in either direction. The panels also include cutting channels so that clean, straight cuts may be simply and quickly made so that the panels have clean straight edges.

The mounting elements are molded into the panels in an embedded configuration in one embodiment. The mounting elements are generally elongate members with a somewhat "H" shaped cross-sectional profile. The first portion extends perpendicularly outward from its center section, which abuts a series of center connecting ribs. The second portion extends from an opposite end of the connecting ribs in a substantially perpendicular configuration with a very slight obtuse "V" shaped profile. The first portion extends to a first face of the panel or just below the first face and includes a channel or channels to receive and recess screw heads used to attach the panels. The second portion also extends to a second face of the panel and may include glue channels and also provides for receiving adhesive type materials. The mounting elements are preferably molded of lightweight plastic material that is impervious to rusting and other corrosion or deterioration and that can provide a foundation for attaching mounting hardware and also provide support for the panel. The mounting elements are non-conductive and do not produce any galvanic corrosion such as other steel framing that is connected to a steel shipping container. The mounting elements fasten in such a manner as to not puncture the shipping container walls that may initiate a future leak. The mounting elements are thermally non-conductive and provide a thermal break from the steel container wall to the interior finishes, unlike steel Z-furring that will lose as much as 50% or the R-value through thermal bridging.

To mount to corrugated walls, such as side walls of a shipping container, the inner mounting face of each panel has a corrugated inner facing surface that is complementary to the corrugated surface, such as the side walls of shipping container. The corrugated mounting surface includes vertically extending protruding portions alternating with vertically extending recesses. The protruding portions include a planar outer face and tapering connection surfaces that form a transition from the planar face of the inner recess to the planar face of the protruding portion. The inner recessed surface and the planar face of the protruding portions are generally parallel to one another and to the exposed surface on the opposite side of each panel. The protruding portions and the recesses extend generally vertically and configured to align with the complementary portions of the corrugated walls of the shipping container. The configuration of the insulation panels provides a tight fit against the corrugated walls without leaving gaps.

The insulation system is easily installed. The panels are installed by gluing or conventional mechanical fasteners to corrugated walls. Panels are placed starting at a lowermost tier and usually in one corner and working horizontally across the width of a wall. The tongues and grooves form connections between adjacent panels so that a continuous water impervious layer is achieved. The panels of each level are typically offset relative to adjacent panels above and below, but are correctly positioned and spaced by the alignment tabs and notches. Moreover, the protruding portions and recesses of the panels are complementary and mate with the corrugated wall and are correctly positioned through the alignment tabs and notches of the panels. Construction of the insulating layer continues in a level by level configuration until reaching the top of the wall. The panels may be trimmed to remove the tongue and grooves from the edges abutting the floor, ceiling and corners for continuous total coverage of the structural wall. After the glue dries, further hardware may be used for mounting to the load bearing wall. Drywall, paneling or other layers may then be attached using conventional hardware to the mounting elements. It can be appreciated that no special skills or special tools are needed for installation. Electrical boxes and other devices may be installed by simply cutting out the portions of a panel and connecting to the wiring or other elements extending through the channels formed by the panels.

The present invention is lightweight, durable, easy to install, long lasting, has improved insulation attributes, is inexpensive, can be used for retrofit applications and minimizes common drawbacks of traditional construction such as mold, water damage and other problems associated with the prior art. The system uses panels that fasten to a structural wall and easy to cut with a conventional knife for individually sizing the panels or cutting additional chases or channels as the panels do not have a metal layer that is thermally conductive or other material that is difficult to cut. The panels have built in utility chases, drainage channels and inter-panel alignment without using special tracks or plates. It can be appreciated that some local ordinances may prohibit the exterior of a shipping container used in constructing a building from being visible. The integrated mounting elements of the insulation system of the present invention provide for easy attachment of conventional exterior claddings.

These features of novelty and various other advantages that characterize the invention are pointed out with particularity in the claims annexed hereto and forming a part hereof. However, for a better understanding of the invention, its advantages, and the objects obtained by its use, reference should be made to the drawings that form a further part hereof, and to the accompanying descriptive matter, in which there is illustrated and described a preferred embodiment of the invention.

BRIEF DESCRIPTION OF THE DRAWINGS

Referring now to the drawings, wherein like reference letters and numerals indicate corresponding structure throughout the several views.

DETAILED DESCRIPTION OF THE PREFERRED EMBODIMENT

Figure 1:
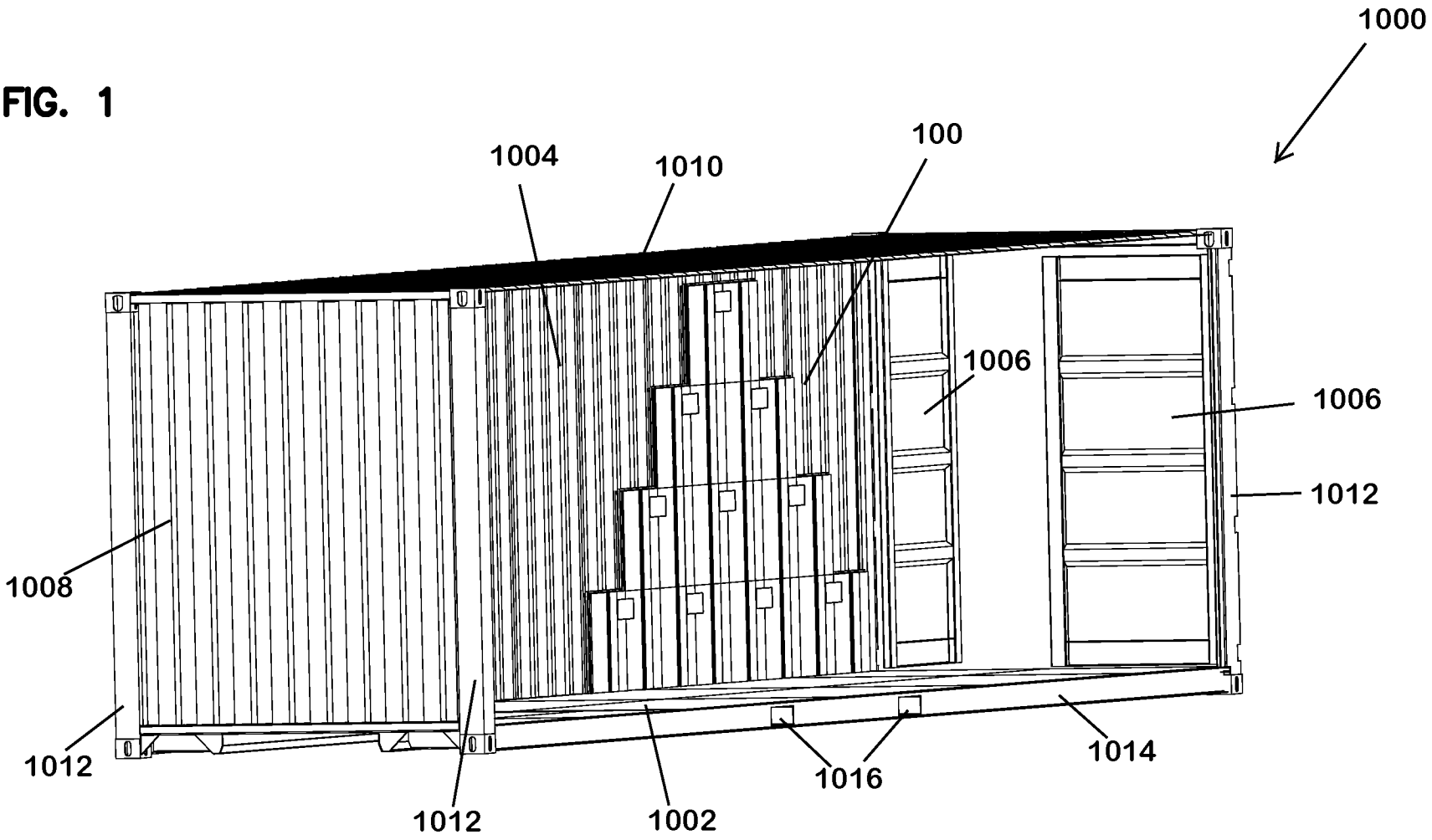
FIG. 1 is a perspective view of a shipping container with portions removed for clarity and with a portion of one wall covered with an insulation system according to the principles of the present invention.
Figure 2:
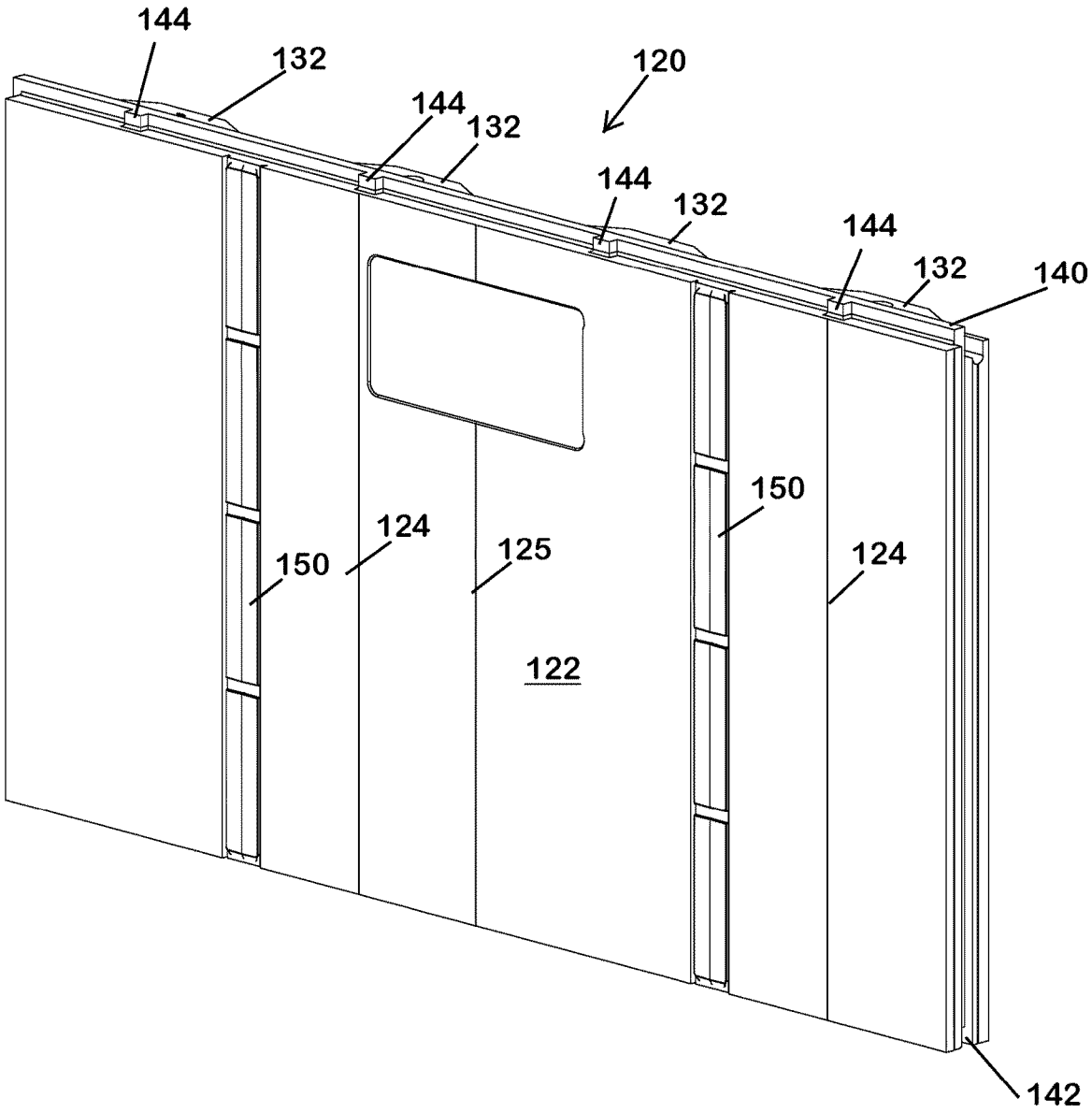
FIG. 2 is a front perspective view of an insulation panel according to the principles of the present invention.
Figure 3:
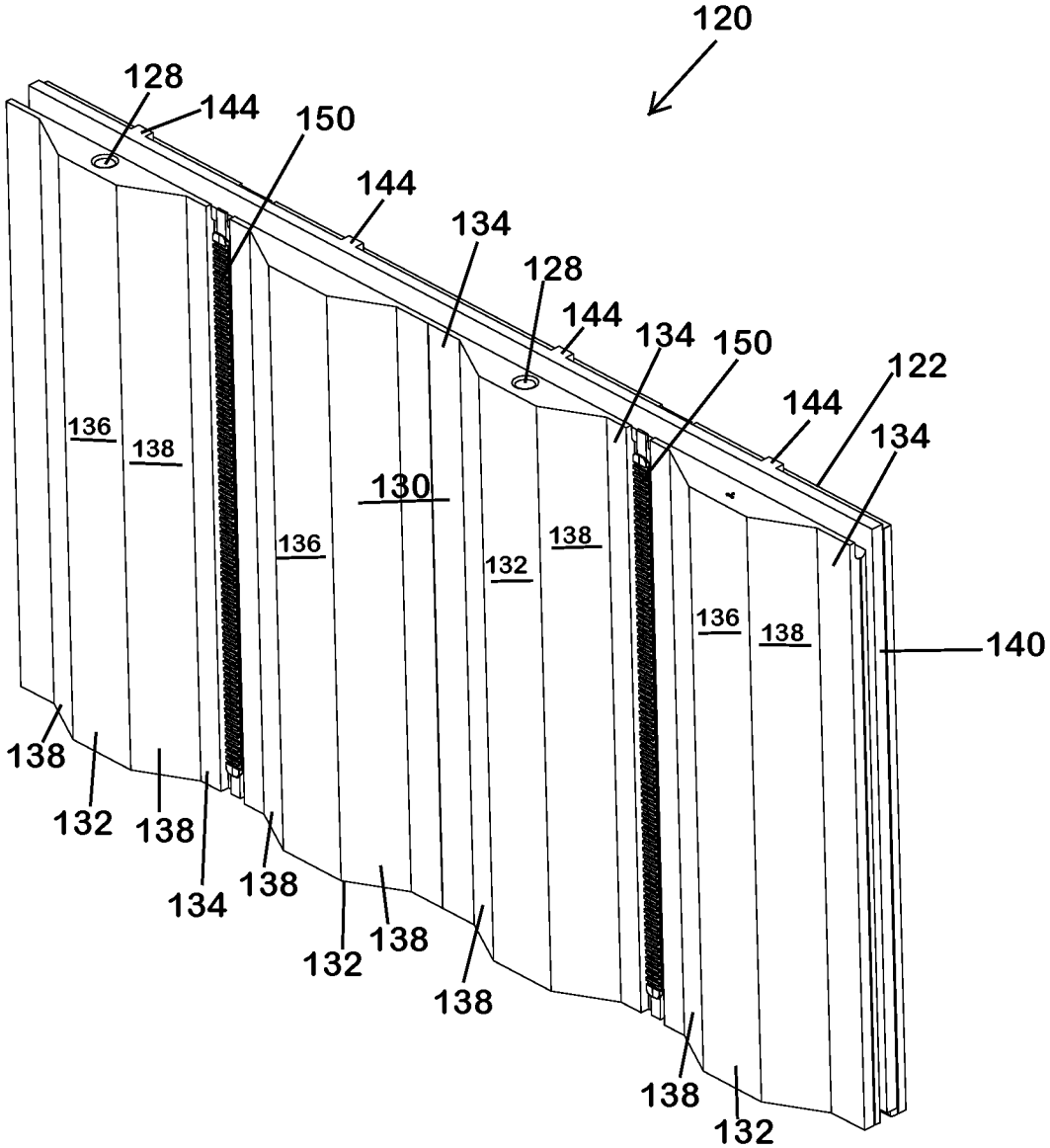
FIG. 3 is a rear elevational view of the insulation panel shown in FIG. 2.
Figure 4:
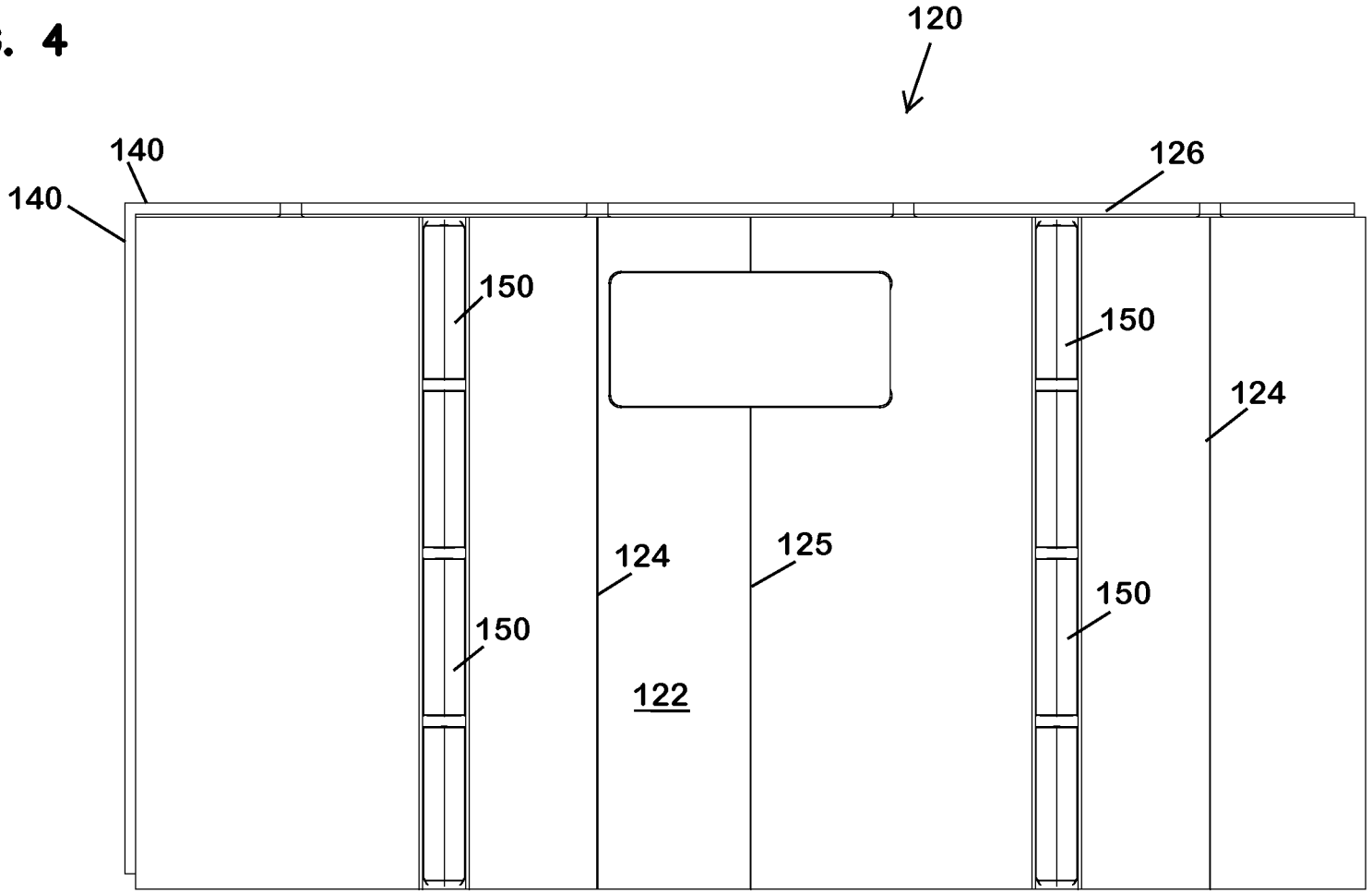
FIG. 4 is a front elevational view of the insulation panel shown in FIG. 2.
Figure 5:
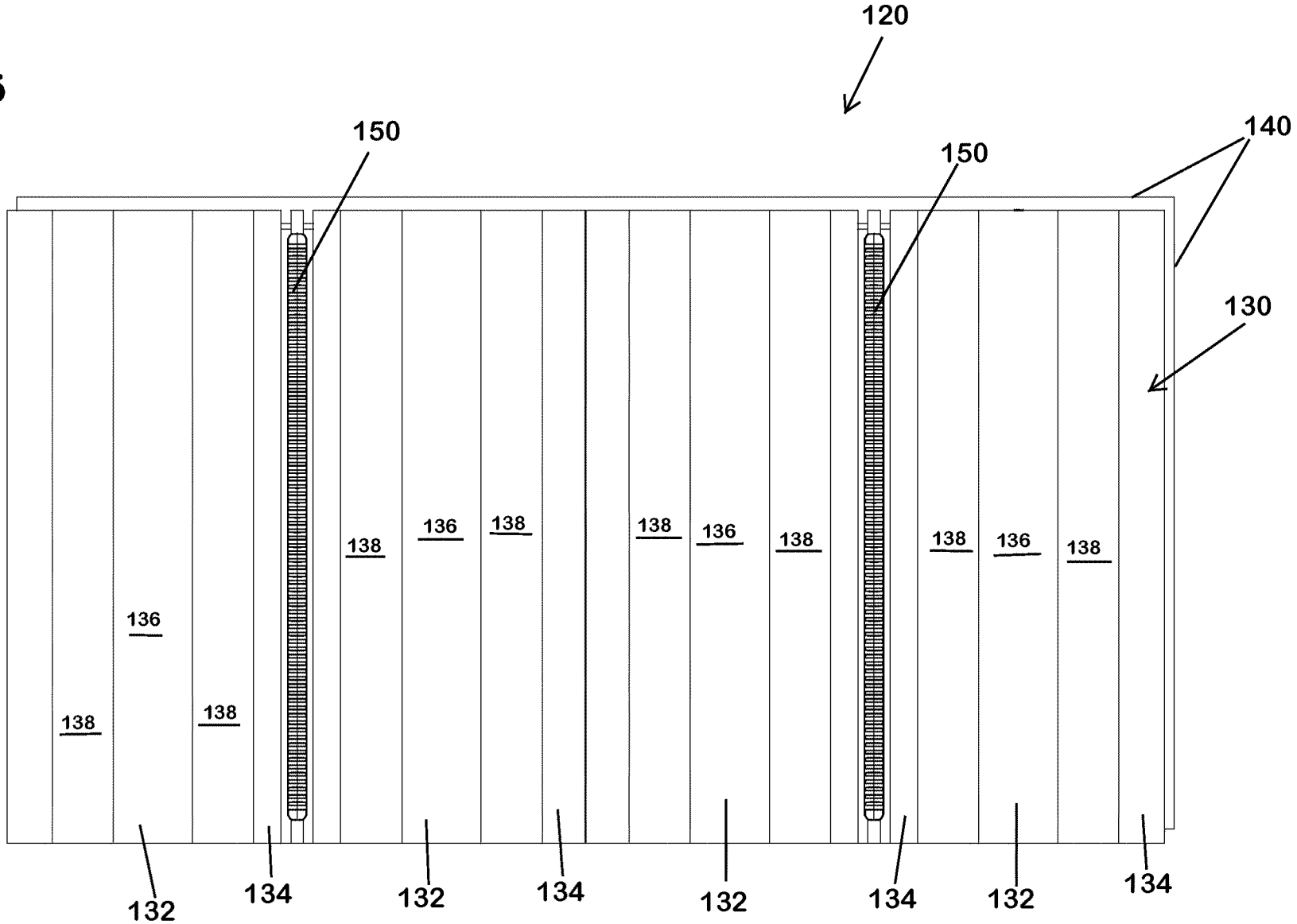
FIG. 5 is a rear elevational view of the insulation panel shown in FIG. 2.
Figure 6:
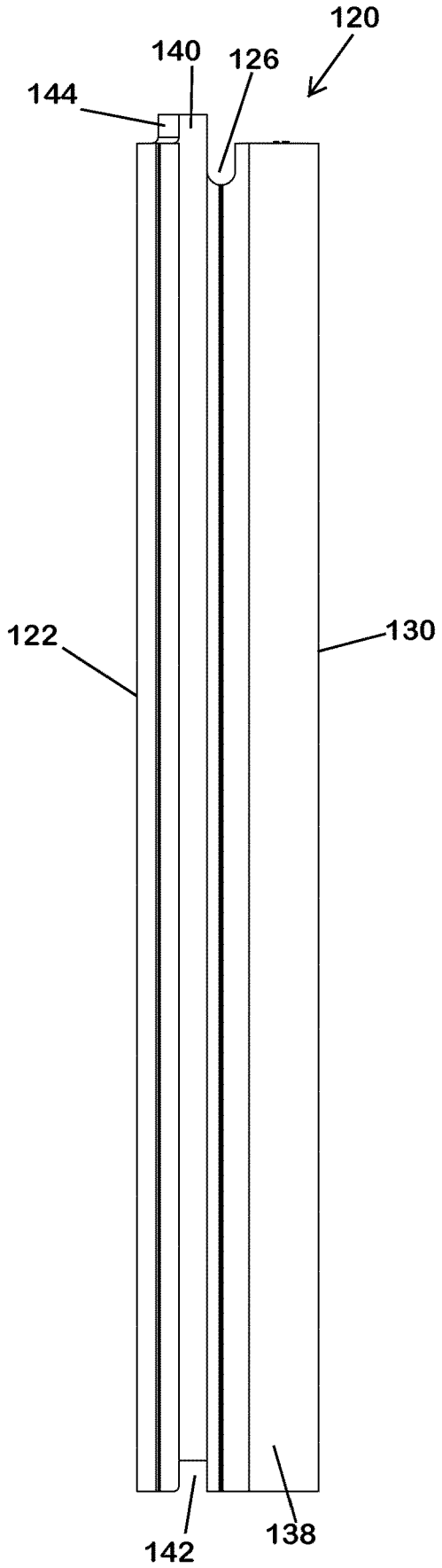
FIG. 6 is a right side elevational view of the insulation panel shown in FIG. 2.
Figure 7:
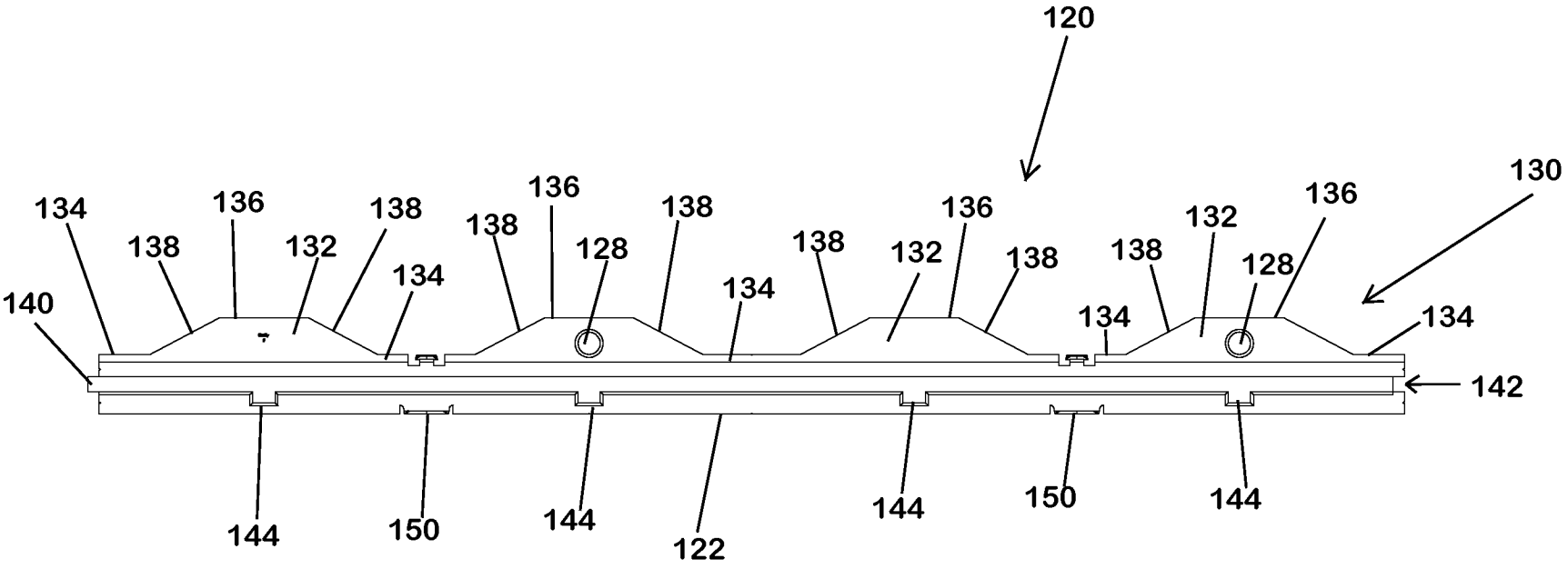
FIG. 7 is a top plan view of the insulation panel shown in FIG. 2.
Figure 8:
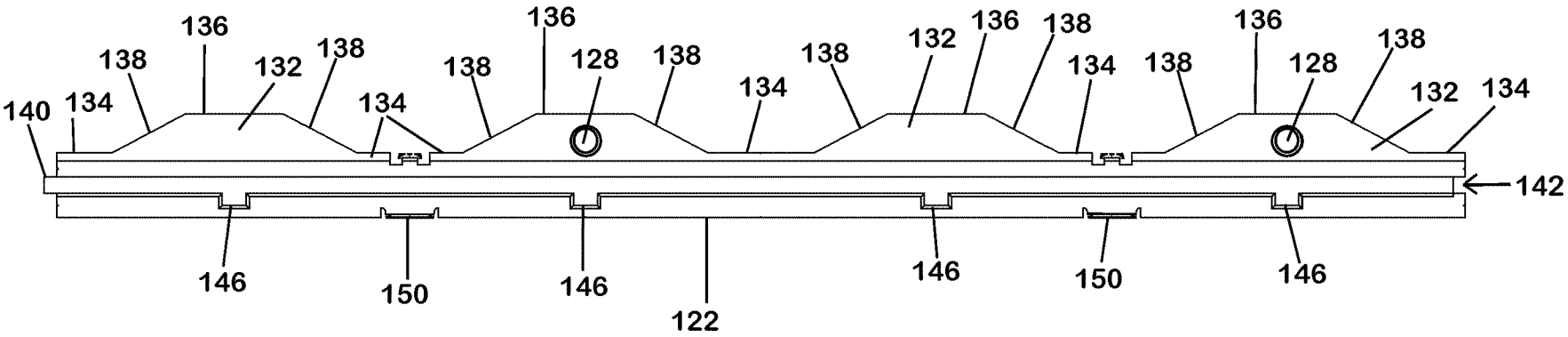
FIG. 8 is a bottom plan view of the insulation panel shown in FIG. 2.

Referring now to the drawings and in particular to FIG. 1, there is shown a wall insulating system, generally designated 100. The insulating system 100 is especially suited for mounting to a shipping container, generally designated 1000. It can be appreciated however that the system 100 of the present invention may be adapted to other types of applications with a complementary non-planar mounting surface.

Shipping containers 1000 are generally rectangular with a floor 1002, side walls 1004, doors 1006, an end wall 1008 and a roof 1010. A standard container is typically 40 feet or 20 feet long, 8 feet 6 inches high and 8 feet wide. Shipping containers are generally made of metal with at least the side walls 1004 and the end wall 1008 configured with a corrugated cross-section to increase the strength of the walls. The corrugations typically have a depth of 1.25 inches up to 2 inches. Corner posts 1012 provide added support for the container 1000 and sufficient support for lifting the container. Bottom frame members 1014 may include openings 1016 for forklift tines or straps.

The insulating system 100 is formed of interconnected panels 120, described hereinafter, that mount to the walls 1004 with glue or conventional fasteners. A finishing layer, such as paneling, drywall or other finishing treatments mounts with fasteners, glue or other conventional mounting techniques to the insulating panels 120. For some applications, a coating such as paint, wallpaper or other final, exposed material that is visible may cover certain finishing layers, such as drywall. The system of the present invention provides for elimination of the conventional stud framing and roll-type insulation being added to a shipping container 1000 and provides improved R-value in a thinner layer, adding floor space and volume to the finished interior of a shipping container. In addition, the present invention is less expensive and easier to install than prior conventional building systems and techniques.

The insulating system 100 is formed from interconnected rectangular insulating panels 120 mounted in an edge-to-edge relationship. As shown in FIGS. 2-8, the panels 120 are generally rectangular and include tongues 140 and complementary grooves 142, such as shown most clearly in FIGS. 2 and 4, along the top and bottom surface and the ends of the panel 120. The tongues and grooves 140 and 142 provide for alignment and connection along both the horizontal and vertical edges so that the panels 120 may be connected to extend horizontally and vertically in a continuous insulating layer. The panels 120 also include alignment tabs 144 and complementary notches 146 along the top and bottom edges that aid in aligning the panels for final orientation. In one embodiment, the panels 120 are made of a closed cell expanded polystyrene material. Such a material is lightweight, provides excellent insulation performance and is impervious to water. Moreover, such material may include a fire retarder. Although a vapor barrier may also be added to the system, it can be appreciated that with the insulating layer 104 made of a water impervious material and with interlocking edges, the need for a separate vapor barrier used in many applications may be eliminated.

Referring again to FIGS. 2-6, each of the panels 120 includes a generally planar outer face 122 having a series of parallel passages 128 that may serve as wiring chases or for running tubing, fiber optics or other elements through the insulating layer without requiring cutting into the panels 120. Indicator lines 124 are aligned with the passages 128 and a centerline 125 acts as a cutting line for cutting the panels 120 into even halves. The passages 128 also allow for water to drain. When the panels 120 are attached, horizontally extending channels 126 are formed. The horizontal channels 126 bypass the vertical passages 128 so that utilities may be run in both directions without intersecting. The vertical passages 128 provide for easy insertion and routing of wiring, tubing and other elements that are typically placed inside walls. In some embodiments, the small section of panel foam between the horizontal channel 126 and the vertical passage 128 may be removed so the channels 126 and the passages 128 connect. A cutting guide may provide for trimming the panels 120 to a common size and provides a guide for forming a straight edge. It can be appreciated that in one embodiment, the panels are approximately 44 inches wide and 24 inches high (122×61 cm). A typical depth for a panel 120 is two inches (5 cm) at the narrower section and about 3.25 inches at the deepest depth of a corrugation. Such a size provides for standard alignment and easily transporting the panels 120 down narrow staircases such as often lead to a basement.

The panels 120 also include mounting elements 150 that serve as studs embedded into the panels. In one embodiment, each panel 120 includes two embedded mounting elements 150. The mounting elements 150 extend vertically when the panels 120 are installed. The mounting elements 150 may be placed at conventional spacing such as at 16 inch (41 cm) centers or varying on center spacing such as approximately 22 inch centers as is typical with wood stud construction. The mounting elements 150 extend to a first face of the panels 120 and provide a surface for gluing as well as receiving conventional fasteners such as bolts, screws and/or nails. The mounting elements 150 are lightweight, but provide rigidity and strength to the panels 120.

Figure 9:
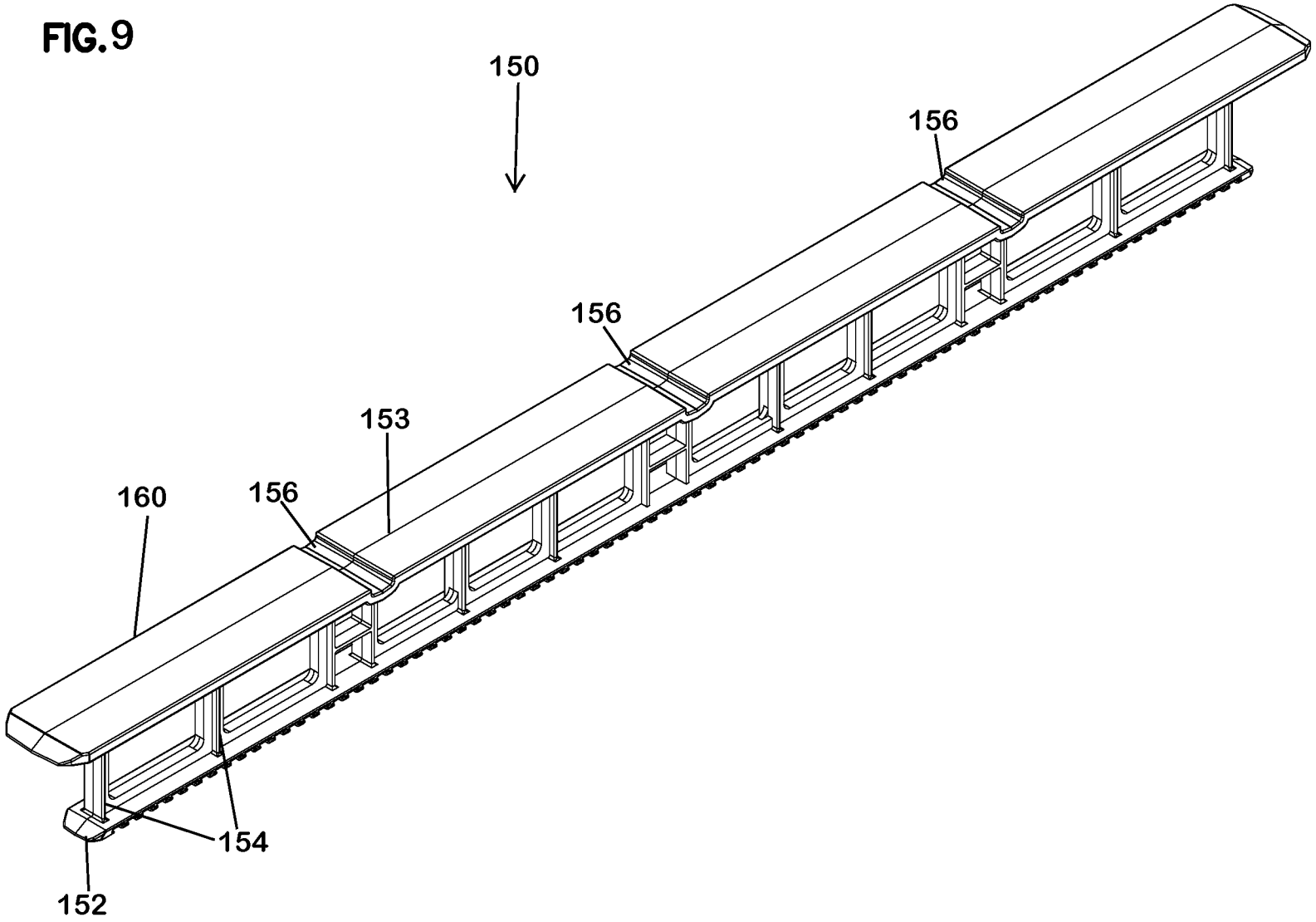
FIG. 9 is a perspective view of mounting element embedded in the panel shown in FIG. 2.
Figure 10:
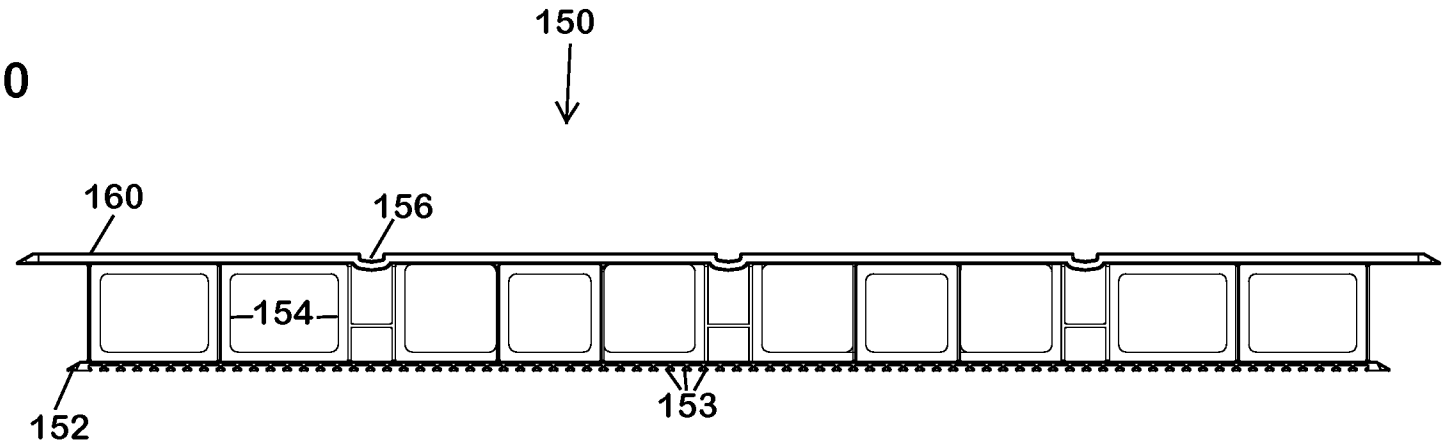
FIG. 10 is a side elevational view of the mounting element shown in FIG. 9.
Figure 11:
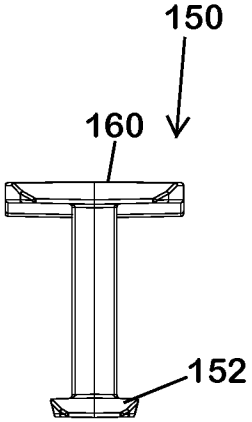
FIG. 11 is an end elevational view of the mounting element shown in FIG. 9.
Figure 12:
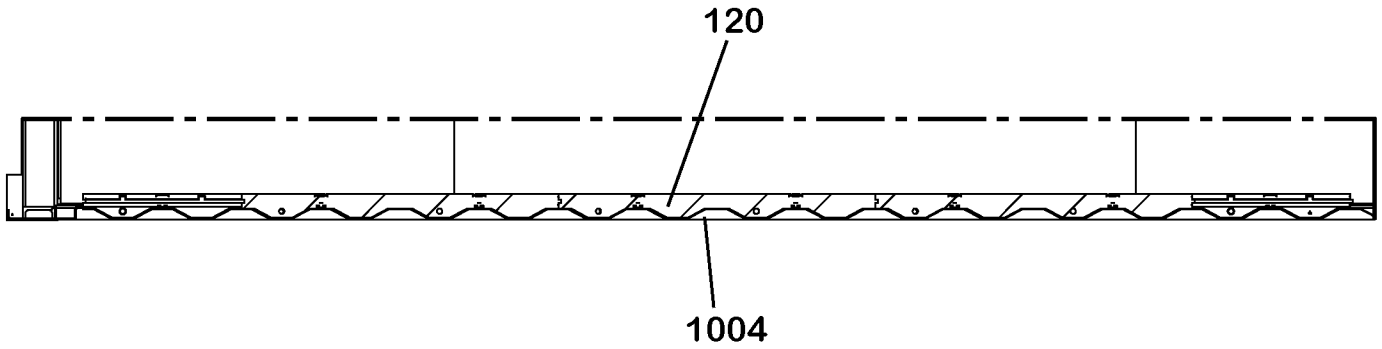
FIG. 12 is a sectional view taken through a wall of the shipping container shown in FIG. 1 with insulation panels installed.
Figure 13:
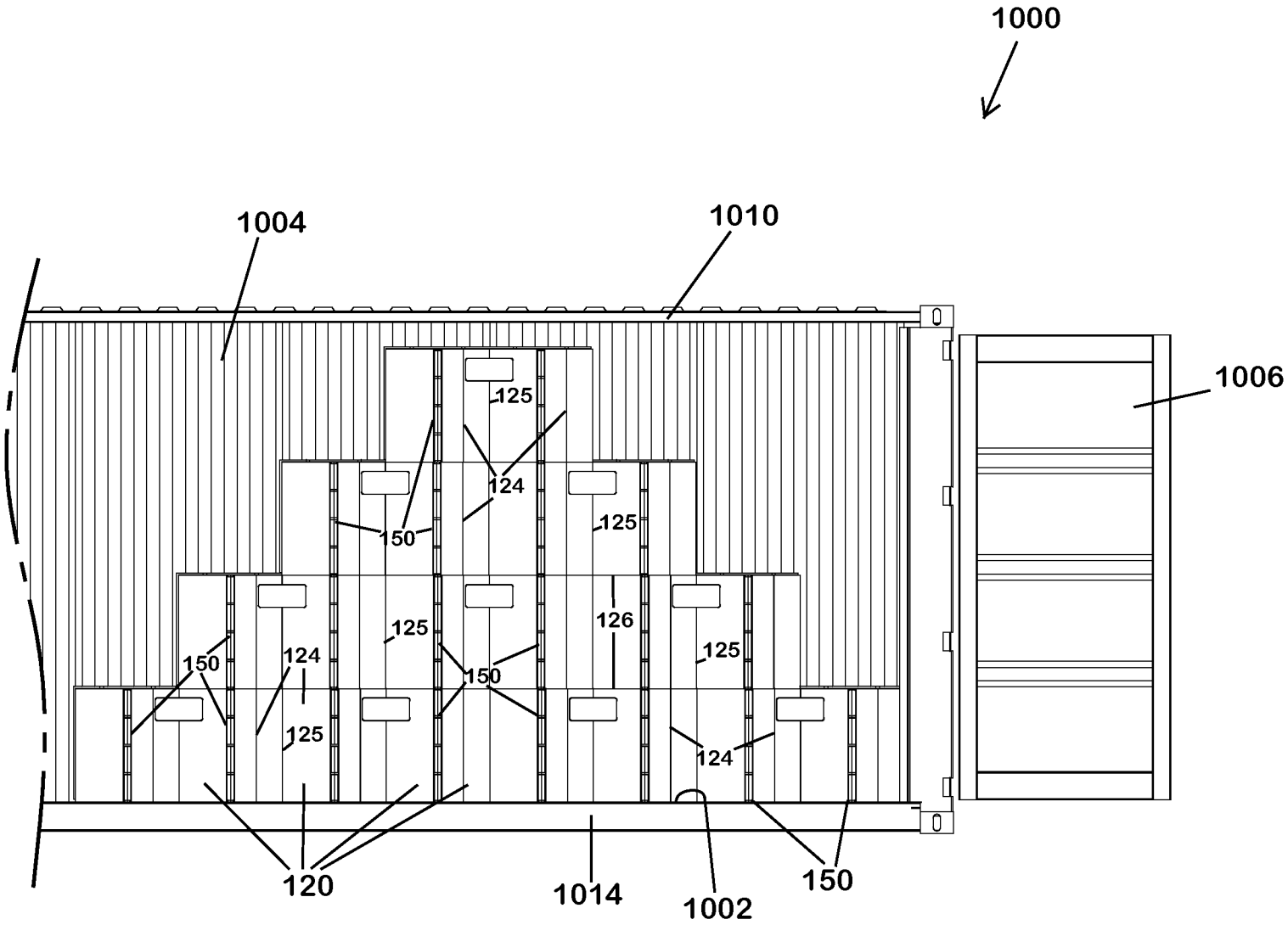
FIG. 13 is an elevational view of an inner wall of the shipping container shown in FIG. 1 with insulation panels installed on a portion of the wall.
Figure 14:
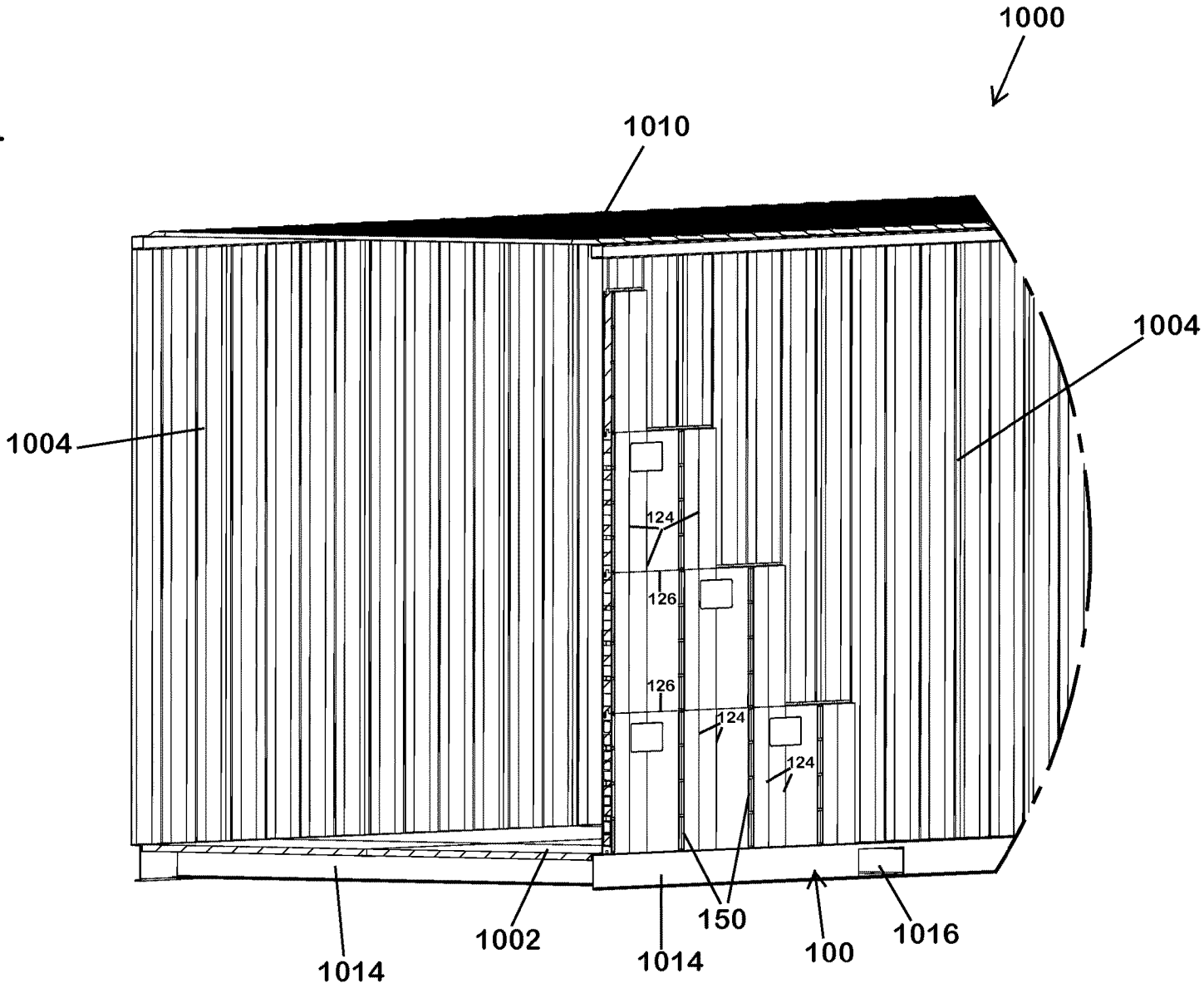
FIG. 14 is a perspective view of a shipping container with portions removed for clarity and with a portion of one outer wall covered with an insulation system according to the principles of the present invention.
Figure 15:
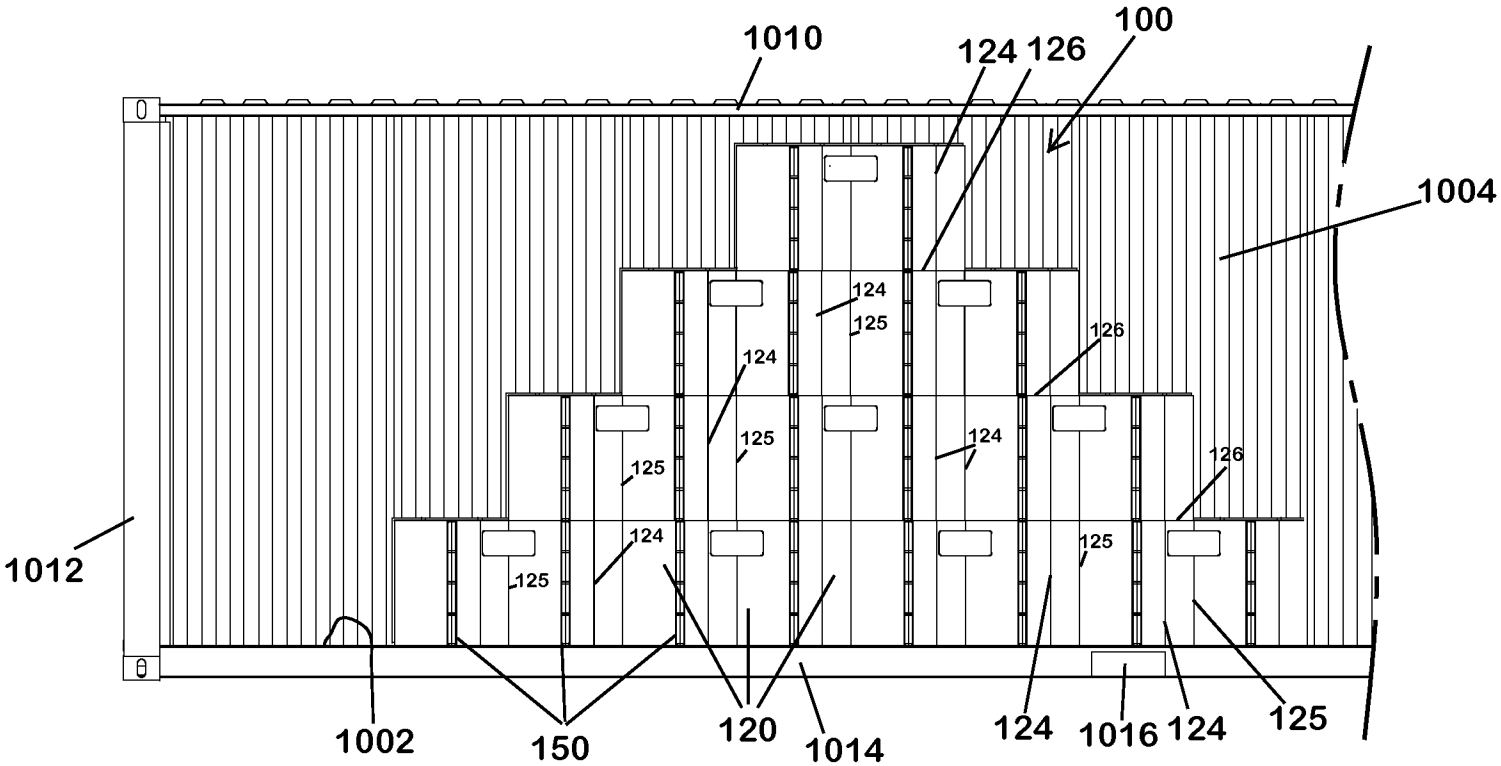
FIG. 15 is an elevational view of an outer wall of the shipping container shown in FIG. 1 with insulation panels installed on a portion of the outer wall.
Figure 16:
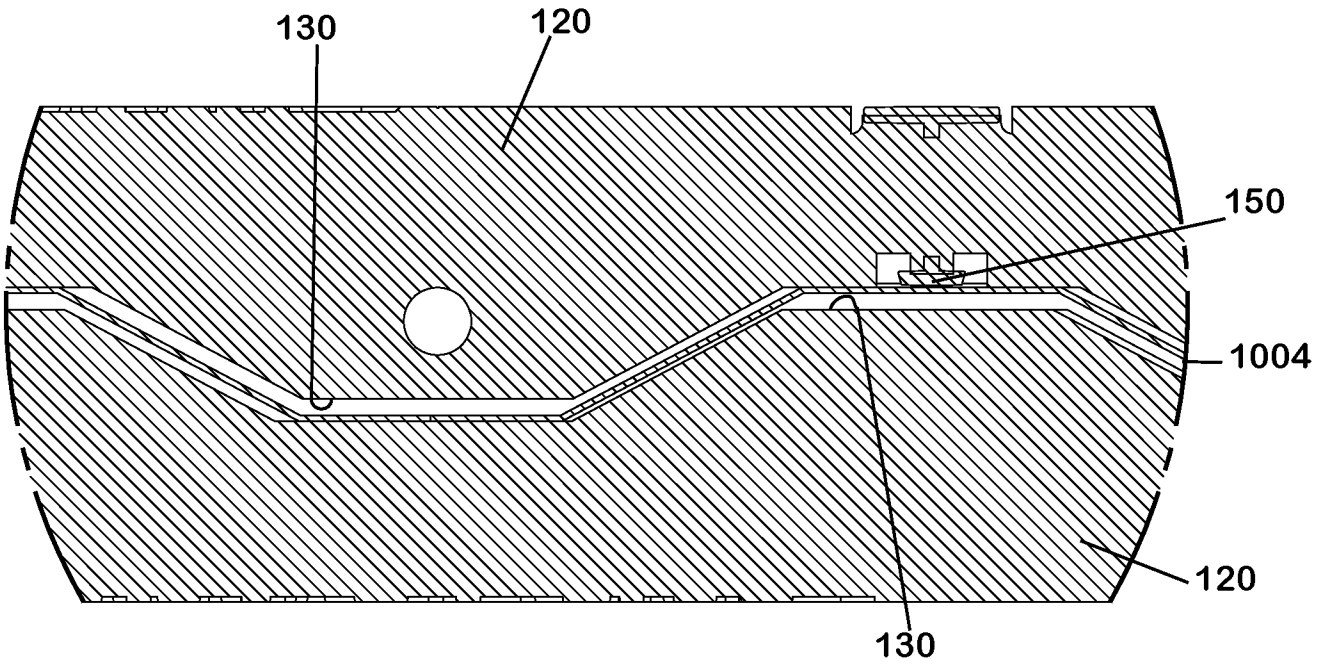
FIG. 16 is a sectional view taken through a wall of the shipping container shown in FIG. 1 with insulation panels installed on an exterior face of the wall and the interior face of the wall.
Figure 17:
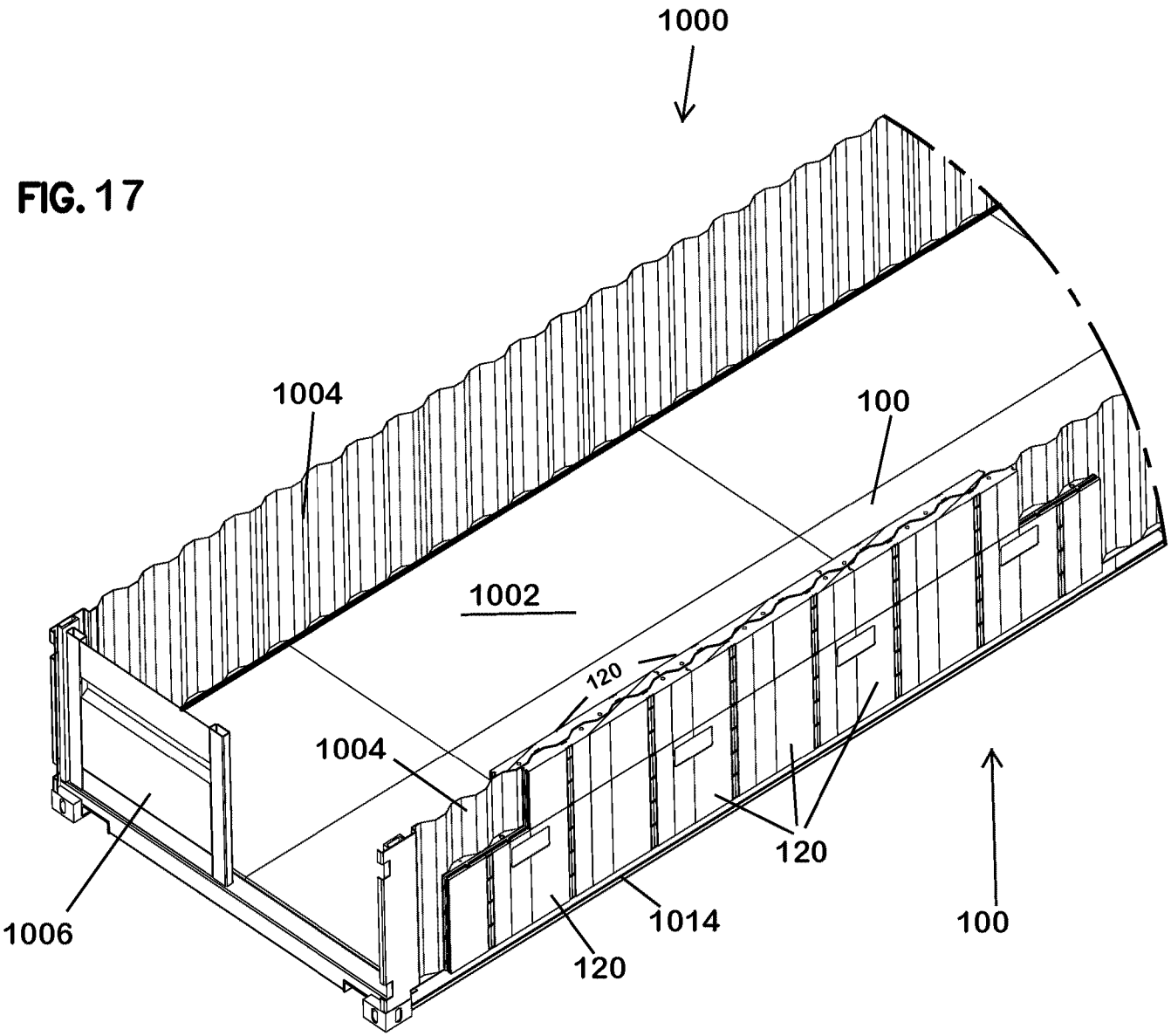
FIG. 17 is a perspective view of a shipping container with portions removed for clarity and with a portion of one outer wall and a portion of the inner wall covered with an insulation system according to the principles of the present invention.
Figure 18:
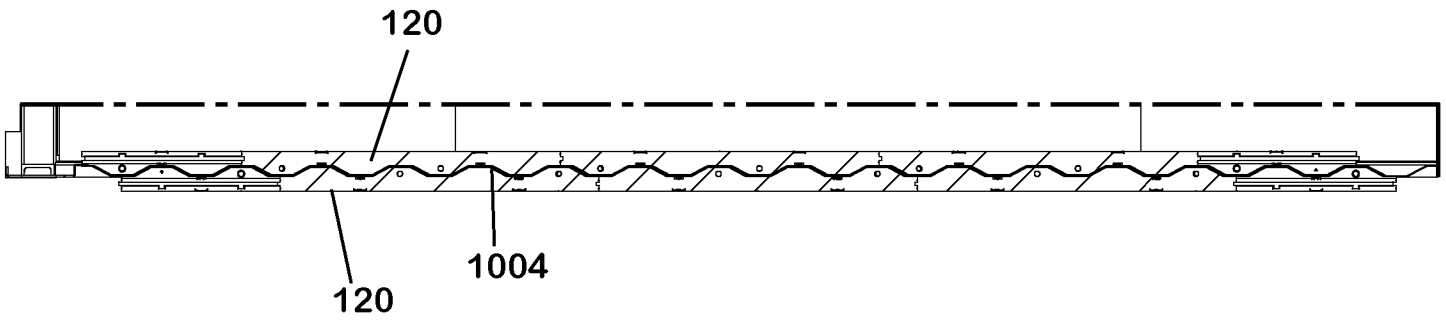
FIG. 18 is a sectional view taken through a wall of the shipping container shown in FIG. 1 with insulation panels installed on an interior face and an exterior face of the wall.

As shown in FIGS. 9-11, each mounting element 150 is a substantially elongate, molded plastic element with a generally "H" shaped cross-sectional profile. The mounting element 150 includes a first mounting portion 152, a second opposed mounting portion 160, and a series of central ribs 154 connecting the first portion 152 and the second portion 160. The first portion 152 extends laterally outward from the ribs 154 at a generally right angle. The ribs 154 may also be configured with portions extending generally diagonally in tension or compression between the first portion 152 and the second portion 160 to aid in transferring loads between the faces. A first face of the first portion 152 includes a glue channel 153 or glue channels transverse to the longitudinal direction. The second mounting portion 160 extends from either side of the center ribs 154. The second portion 160 also includes transverse channels 156 on an outer face and substantially extending transverse to the longitudinal axis of the mounting element 150. The outer channels 156 may also serve as glue channels for mounting.

Referring again to FIGS. 2-8, to mount to corrugated walls, such as side walls 1004 of a shipping container, an inner mounting face 130 of each panel 120 has a corrugated surface that is complementary to the corrugated surface of the side walls 1004. The corrugated mounting surface 130 includes protruding portions 132 alternating with recesses 134. The protruding portions 132 include a planar face 136 and tapering connection surfaces 138 that lead from the protruding planar face 136 to the planar face of the inner recess 134 and are orthogonal to the faces 134 and 136. The inner recessed surface 134 and the planar faces 136 of the protruding portions 132 are generally parallel to one another and to the exposed surface on the opposite side of each panel 120. The protruding portions 132, the recesses 134 and the connection surfaces extend generally vertically to align with the complementary portions of the corrugated walls of the shipping container 1000. The configuration of the panels 120 provides a tight fit against the corrugated walls 1004 without gaps as shown in FIGS. 12 and 16-18.

Figure 19:
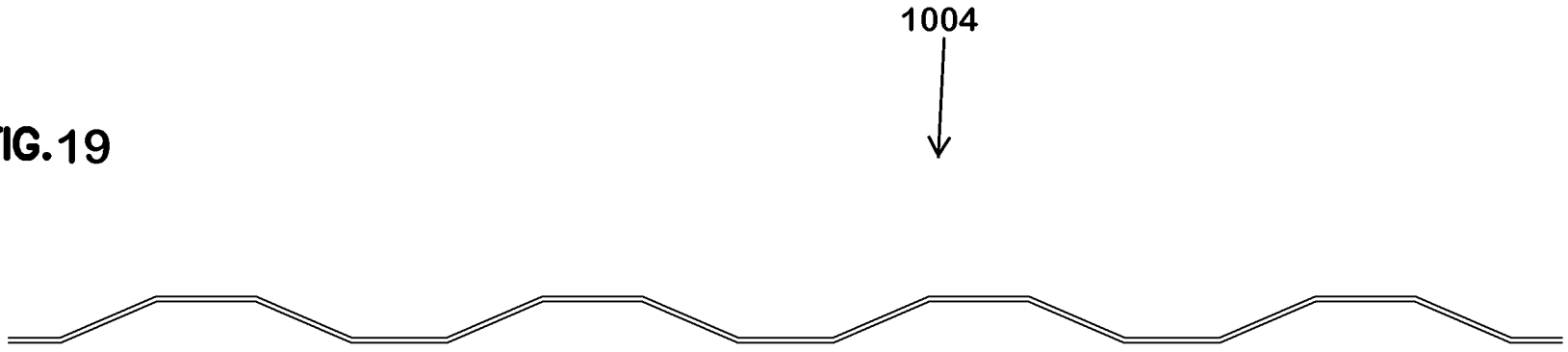
FIG. 19 is a sectional view taken through a side wall of the shipping container shown in FIG. 1.
Figure 20:
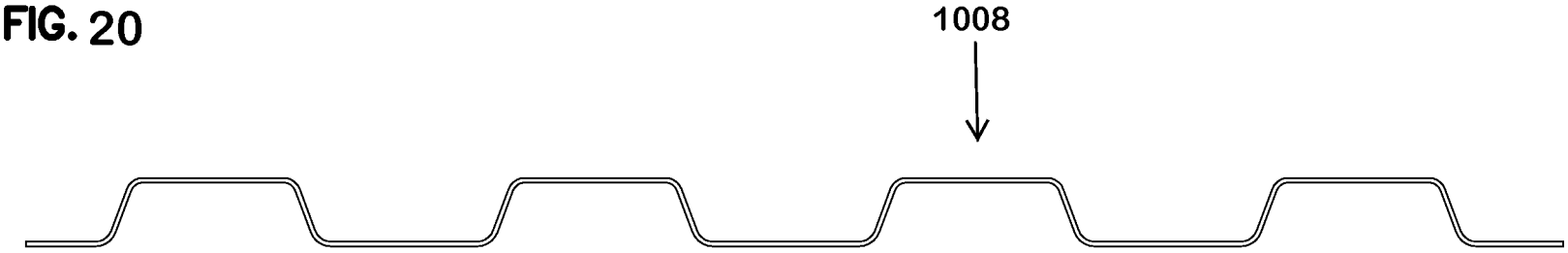
FIG. 20 is a sectional view taken through an end wall of the shipping container shown in FIG. 1.

As shown in FIGS. 19 and 20, the side walls 1004 and the end walls 1008 may have a different corrugation pattern with slightly different dimensions and angles for the protruding portions and the recesses. The panels 120 may be configured with a mounting surface that fits the particular corrugation pattern of the wall to which it is mounted. Moreover, as the walls 1004 are symmetrical, the panels 120 may mount to either the interior or the exterior surface of a corrugated wall 1004.

The mounting elements 150 are spaced apart generally at common intervals such as 8 inches, 12 inches or 16 inches, or at 11 inches or 22 inches or other standard spacing for shipping container corrugations, and provide a lightweight yet durable surface for receiving mounting hardware, as discussed above. The mounting elements 150 are also lightweight and molded and impervious to water for durable and inexpensive construction. It can be appreciated that the system of the present invention reduces the likelihood for water damage, mold and other problems that conventional systems are prone to, especially when the shipping container 1004 is in a damp environment. It can further be appreciated that the present invention provides for easy trimming and cutting with a hand saw or simple knife. The materials used are not irritating to skin or eyes and do not require special gloves for handling as is needed for fiberglass systems. The materials are lightweight and of a size that is easier to handle than typical long wood studs and 4 feet by 8 feet sheets of drywall. Drywall does not need to be aligned with studs as is required with conventional techniques. Installation is much quicker and does not require special skills or tools.

The insulating system 100 of the present invention is also easy to install. Little preparation is needed but drain tile, if necessary, is installed before the system is in place. A bead of construction adhesive is placed in the gluing channels 153 on the studs 150 on each panel 120. Installation generally starts in a lower corner of the wall 1004 with the panel 120 simply pressed onto the inner face of a side wall 1004 or end wall 1008. The panel 120 is then secured with an adhesive or conventional mounting hardware. Installation continues with the panels 120 until a level of panels 120 is completed. The panels 120 of an adjacent level are aligned with vertically extending tongues 140 inserting into corresponding grooves 142 until a bottom row of panels 120 extends across the wall. The panels 120 of the next row are generally offset from the previous row and placed starting along one edge and working along the row in a similar manner. The mounting elements 150 are aligned by the alignment tabs 144 inserting into the corresponding notches 146. The panels 120 are configured so that the passages 128 must align. Construction continues along horizontal rows until the entire surface of a wall is covered. The corners are accommodated by cutting off the tongues and/or grooves and butting the panels 120 together.

Spaces for receiving electrical boxes can be cut into the panels 120 using a standard drywall keyhole saw. Wiring and other elements can be run through the insulation system panels 120 by leading the wiring through the passages 128 and the channels 126. When the panels 120 have been installed, the glue is generally allowed to dry for a period of time such as 24 hours. Once the glue sets, the drywall can be applied to the planar outer face 122 by using standard drywall screws attaching to the mounting elements 150. The insulation system 100 is finished in the same manner as conventional walls with mud and tape used with the drywall and an inner layer such as paint or wallpaper applied over the drywall. In some applications, paneling or other materials may be used rather than drywall. The method is typically faster and easier with less skill and fewer tools required than conventional construction techniques.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An insulation panel comprising:

a first face;

a second face;

a first end having a first coupling surface;

a second end opposite the first end, the second end having a second coupling surface configured to mate with the first coupling surface;

a first alignment portion on a top surface of the panel and a second alignment portion on a bottom surface of the panel, the second alignment portion being complementary to the first alignment portion;

the second face having a corrugated surface, the corrugated surface comprising a first planar surface parallel to the first face, a recessed second planar surface spaced apart from and parallel to the first planar surface, and third and fourth planar surfaces extending between the first planar surface and the second planar surface, the third and fourth planar surfaces being oblique to the first and second planar surfaces.

2. An insulation panel according to claim 1, wherein the panel comprises a planar panel.

3. An insulation panel according to claim 1, further comprising a vertical passage extending through the panel.

4. An insulation panel according to claim 3, wherein the vertical passage is located intermediate the third and fourth planar surfaces.

5. An insulation panel according to claim 1, wherein the panel comprises a water impervious foam panel.

6. An insulation panel according to claim 1, further comprising a support embedded in the panel.

7. An insulation panel according to claim 1, wherein the first planar surface forms an obtuse angle with each of the third and fourth planar surfaces and the second planar surface forms an obtuse angle with each of the third and fourth planar surfaces.

8. An insulation panel according to claim 1, wherein each of the first planar surface, the second planar surface, the third planar surface and the fourth planar surface has a width greater than a distance between a plane of the first planar surface and a plane of the second planar surface.

9. An insulated shipping container comprising:

a container, the container comprising:

a base;

a roof;

walls extending between the base and the roof, at least one of the walls having a corrugated surface;

a door;

a plurality of insulation panels, each of the insulation panels comprising:

a first face;

a second face;

a first end having a first coupling surface;

a second end opposite the first end, the second end having a second coupling surface configured to mate with the first coupling surface;

a first alignment portion on a top surface of the panel and a second alignment portion on a bottom surface of the panel, the second alignment portion being complementary to the first alignment portion;

the second face having a corrugated surface, the corrugated surface comprising a first planar surface parallel to the first face, a second planar surface spaced apart from and parallel to the first planar surface, and third and fourth planar surfaces extending between the first planar surface and the second planar surface, the third and fourth planar surfaces being oblique to the first and second planar surfaces.

10. A shipping container according to claim 9, the corrugated surface of the second face of the insulation panels being complementary to the corrugated surface of the walls.

11. A shipping container according to claim 9, wherein the shipping container comprises an interior and wherein the insulation panels are mounted to the interior of the at least one wall.

12. A shipping container according to claim 9, further comprising a support embedded in the panel.

13. A shipping container according to claim 9, wherein the first planar surface forms an obtuse angle with each of the third and fourth planar surfaces and the second planar surface forms an obtuse angle with each of the third and fourth planar surfaces.

14. A shipping container according to claim 9, wherein each of the first planar surface, the second planar surface, the third planar surface and the fourth planar surface has a width greater than a distance between a plane of the first planar surface and a plane of the second planar surface.

15. A method of insulating a shipping container including a base, a roof, walls extending between the base and the roof, at least one of the walls having a corrugated surface, and a door; the method comprising:

providing a plurality of insulation panels, each of the insulation panels comprising:

a first face;

a second face;

an insert embedded in the panel;

a first end having a first coupling surface;

a second end opposite the first end, the second end having a second coupling surface configured to mate with the first coupling surface;

a first alignment portion on a top surface of the panel and a second alignment portion on a bottom surface of the panel, the second alignment portion being complementary to the first alignment portion;

the second face having a corrugated surface, the corrugated surface comprising a first planar surface parallel to the first face, a planar second surface spaced apart from and parallel to the first planar surface, and third and fourth planar surfaces extending between the first planar surface and the second planar surface, the third and fourth planar surfaces being oblique to the first and second planar surfaces;

mounting a plurality of the insulation panels to the walls of the container so complementary portions of the corrugated surface of each panel engage the corrugated surface of at least one of the walls;

aligning and engaging the first alignment portion with the second alignment portion of a vertically adjacent panel; and aligning and mating the first and second ends of laterally adjacent ones of the panels.

16. A method according to claim 15, wherein the shipping container comprises an interior and wherein the insulation panels are mounted to the interior of the at least one wall.

17. A method according to claim 15, wherein the shipping container comprises an exterior and wherein the insulation panels are mounted to the exterior of the at least one wall.

18. A method according to claim 15, wherein the shipping container comprises an interior and an exterior, and wherein the insulation panels are mounted to the interior of the at least one wall and are mounted to the exterior of the at least one wall.

19. A method according to claim 15, wherein the first planar surface forms an obtuse angle with each of the third and fourth planar surfaces and the second planar surface forms an obtuse angle with each of the third and fourth planar surfaces.

20. A method according to claim 15, wherein each of the first planar surface, the second planar surface, the third planar surface and the fourth planar surface has a width greater than a distance between a plane of the first planar surface and a plane of the second planar surface.

* * * * *